United States Patent [19]

Erben

[11] 4,161,052

[45] Jul. 17, 1979

[54] METHOD AND APPARATUS FOR MAKING A UNIFORM, CONTINUOUS SLIVER

[75] Inventor: Ludwig Erben, Mönchen-Gladbach, Fed. Rep. of Germany

[73] Assignee: Trutzschler GmbH & Co. KG, Monchen-Gladbach, Fed. Rep. of Germany

[21] Appl. No.: 862,690

[22] Filed: Dec. 21, 1977

[30] Foreign Application Priority Data

Dec. 22, 1976 [DE] Fed. Rep. of Germany ..... 2658044

[51] Int. Cl.[2] ..... D01H 5/38

[52] U.S. Cl. ..... 19/240; 19/105

[58] Field of Search ..... 19/239–241, 19/105; 302/28; 222/55

[56] References Cited

U.S. PATENT DOCUMENTS 3,474,501 10/1969 Jeanmaire ..... 19/239 X 3,984,895 10/1976 Grice, Jr. ..... 19/240

FOREIGN PATENT DOCUMENTS 930873 7/1963 United Kingdom ..... 19/240

*Primary Examiner*—Dorsey Newton

*Attorney, Agent, or Firm*—Spencer & Kaye

[57] ABSTRACT

An apparatus for making a uniform, continuous sliver has a sliver sensor for continuously sensing the throughput quantity of the sliver and generating a continuous main regulating signal x as a function of the throughput quantity and a first regulator connected to the sliver sensor for receiving the signal x and generating a reference signal $w_h$ as a function of the signal x. The apparatus further has a tuft column sensor connected to a tuft shaft of a card for sensing a variable of the tuft column advancing in the tuft shaft. The tuft column sensor has a signal generator for emitting an auxiliary regulating signal $x_h$ as a function of the sensed variable of the tuft column and a desired value setter which receives the signal $w_h$ and varies the signal $x_h$ as a function of the signal $w_h$. Further, the apparatus has a tuft column altering arrangement including a second, auxiliary regulator which receives the signal $x_h$ and applies a setting signal y to a card feeder for altering the tuft column as a function of the signal $x_h$.

14 Claims, 2 Drawing Figures

METHOD AND APPARATUS FOR MAKING A UNIFORM, CONTINUOUS SLIVER

BACKGROUND OF THE INVENTION

This invention relates to a method and an apparatus for making a uniform, continuous sliver, wherein the tuft column is measured in a tuft shaft as a function of a deviation which, in turn, is measured at the running sliver supplied by the tuft shaft.

In a known method of the above-outlined type, a signal representing the deviation of the sliver weight from a desired value is applied to a regulator which accordingly varies the rpm of a blower generating a pressure in a sole tuft shaft. With this method, sliver fluctuations may be measured, for example, downstream of the carding machine. The setting member and the blower are located externally of the tuft shaft. This process has the disadvantage that the regulator output affects a continuously operating setting member; consequently, the pressure difference prevailing in the tuft shaft varies continuously. Further, in the above-outlined method, only in case of a continuously operating setting member can the regulation be effected beyond a predetermined deviation from a desired value. It is a further disadvantage of the above-outlined method that its application is limited to an arrangement of the setting member externally of the tuft shaft and thus it is limited to a regulation of the pressure drop in a single tuft shaft.

SUMMARY OF THE INVENTION

It is an object of the invention to provide an improved method of the above-outlined type wherein the regulator output admits a non-continuous alteration of the tuft column, wherein the alteration is effected beyond a predetermined deviation from a desired value and which may find application in a tuft feeding apparatus having an upper and a lower tuft shaft.

This object and others to become apparent as the specification progresses, are accomplished by the invention, according to which, briefly stated, the method of making a uniform, continuous sliver includes the steps of sensing, as a function of a deviation, a variable of an advancing tuft column in a tuft shaft of a card feeder; generating a first regulating signal $x_h$ as a function of the sensed magnitude of the variable; applying the signal $x_h$ to a first regulator; generating a setting signal y in the first regulator as a function of the signal $x_h$; applying the signal y to the card feeder for varying the tuft quantities; setting a desired value for the first regulator by a reference signal $w_h$; continuously sensing a variable of an advancing sliver continuously formed of the advancing tuft column; generating a second regulating signal x as a function of the magnitude sensed in the preceding step; applying the signal x to a second regulator; and generating the signal $w_h$ in the second regulator as a function of the signal x.

By providing that the tuft quantities are altered in the tuft shaft, a non-continuous alteration of the tuft column may be effected. Thus, the tuft quantities may be regulated by energizing and de-energizing the tuft feed devices associated with the tuft shaft, so that the method may find application in a tuft feeding apparatus having an upper and a lower tuft shaft, wherein the tufts are directly introduced into the lower tuft shaft. By setting the desired value of the first regulator (hereafter the auxiliary regulator) by means of a varying reference value, it is feasible to effect a non-continuous alteration of the tuft column beyond a predetermined deviation from the desired value. Thus, the method according to the invention makes possible an elimination of long-period sliver oscillations by regulation and, at the same time, a regulation of the non-continuous alteration of the tuft column may be effected in an advantageous manner beyond a predetermined deviation from the desired value.

Expediently, the maximum regulator output is sensed at the lower tuft shaft; preferably, as the first regulating signal (hereafter the auxiliary regulating signal) there is utilized an electric signal derived from the pressure prevailing in the lower tuft shaft.

The non-continuous alteration of the tuft quantity may be effected in a simple manner by generating a digital signal as the setting signal, applied to the drive means of the feeding roll associated with the lower tuft shaft.

For eliminating the long-period sliver oscillations by regulation, preferably the output rate (quantity/time) of the carding machine is utilized. The desired value setting of the auxiliary regulator is expediently effected in the zone where the magnitude for the auxiliary regulating signal is sensed.

The invention further relates to an apparatus for performing the above-outlined method. The apparatus has an auxiliary measuring member operatively connected, by means of an auxiliary regulator, with a setting member for altering the tuft column in the tuft shaft and further, a sliver quantity measuring member is connected, by means of a regulator, with a desired value setting member for controlling a reference signal for the auxiliary measuring member.

Advantageously, the auxiliary measuring member is a pressure-responsive precision sensor arranged in the lower tuft shaft. In order to effect a non-continuous alteration of the tuft quantities in a structurally simple manner, the feeding roll for the lower tuft shaft constitutes itself the setting member. In order to eliminate the long-period sliver oscillations, the measuring member is arranged preferably downstream of the carding machine.

Expediently, a digital regulator, particularly a three-point regulator is used as the regulator; this results in an economical manufacture of the apparatus.

In order to sense deviations from the desired value rapidly and in a simple manner, an optical and/or acoustic indicator is connected to the regulator. Advantageously, to the regulator there is connected a recorder such as a multi-color dot plotter to make possible the observation of the sliver control over long periods.

Expediently, a setting motor is used as the desired value setter. To ensure that the reference value for the auxiliary measuring member is predetermined in a secure manner, according to a preferred embodiment of the invention, the setting motor varies the distance between a diaphragm and an inductive switch.

DESCRIPTION OF THE PREFERRED EMBODIMENTS

Figure 1:
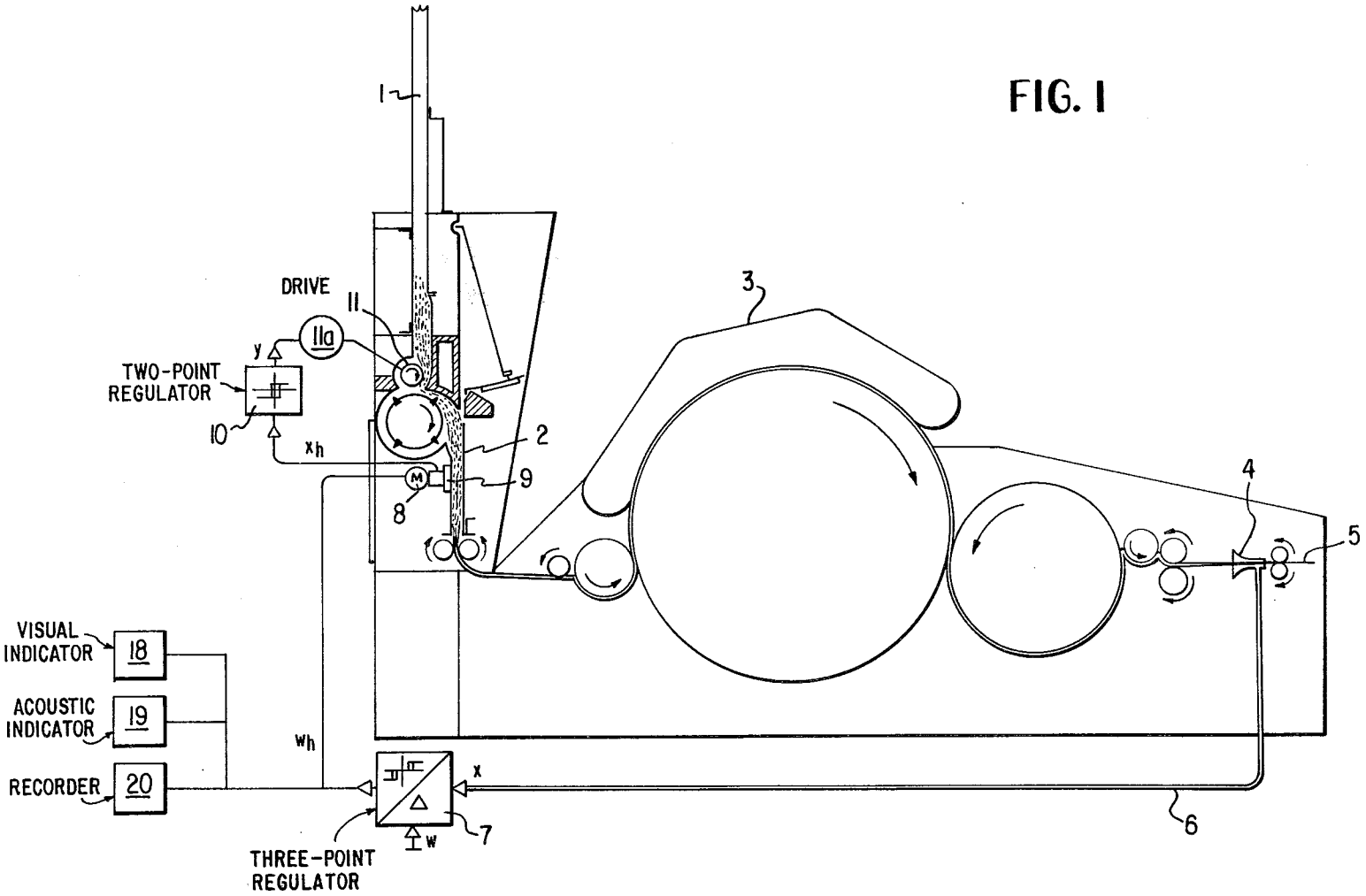
FIG. 1 is a schematic illustration of a preferred embodiment of the invention coupled with a carding machine.

Turning now to FIG. 1, a fine opening stream introduces textile fiber tufts in an upper tuft shaft 1 (material storage shaft) and a lower tuft shaft 2 (feeding shaft) of a card feeder. The latter introduces the textile fiber tufts as a web into the carding machine 3. The web discharged by the carding machine 3 is combined into a sliver by a sliver funnel 4.

An electronic pressure-responsive precision sensor switch 9, functioning as an auxiliary measuring member, is mounted on a wall of the lower tuft shaft 2. The switch 9 is coupled, by means of an auxiliary regulator 10, such as a two-point regulator, with the drive 11*a* of the feeding roll 11 provided for the lower tuft shaft 2.

The sliver funnel 4 arranged downstream of the carding machine 3 simultaneously functions as a measuring member for the sliver 5. The sliver funnel 4 is connected with a regulator 7, such as a three-point regulator, by means of a conduit 6 through which signals are applied to the regulator 7. The three-point regulator 7 is connected by means of an electric conductor with a setting motor 8 which is mechanically directly connected with the pressure-responsive precision switch 9. In operation, the switch 9 measures the pressure prevailing in the lower tuft shaft 2. A digital electric signal is, as an auxiliary regulating signal $x_h$ derived from the pressure prevailing in the lower tuft shaft 2. The signal $x_h$ is applied to the two-point regulator 10 which, in response, generates a setting output signal y. The latter is applied to the drive 11*a* of the feeding roll 11. By energizing or de-energizing the feeding roll 11, there is achieved a non-continuous alteration of the tuft quantities in the lower tuft shaft 2.

The long-period fluctuations of the running sliver 5 are continuously sensed by means of the sliver funnel 4 which emits a pneumatic signal x representing the deviation of the actual value. The signal x which is the main regulating signal, is the input for the three-point regulator 7 where it is compared with the predetermined desired value w. In response to this comparison, the three-point regulator 7 emits a digital signal constituting the reference output signal $w_h$ which serves for setting the desired value at the pressure-responsive precision switch 9 by means of the setting motor 8. In this manner, the output of the three-point regulator 7 effects the desired value setting of the two-point regulator 10.

Figure 2:
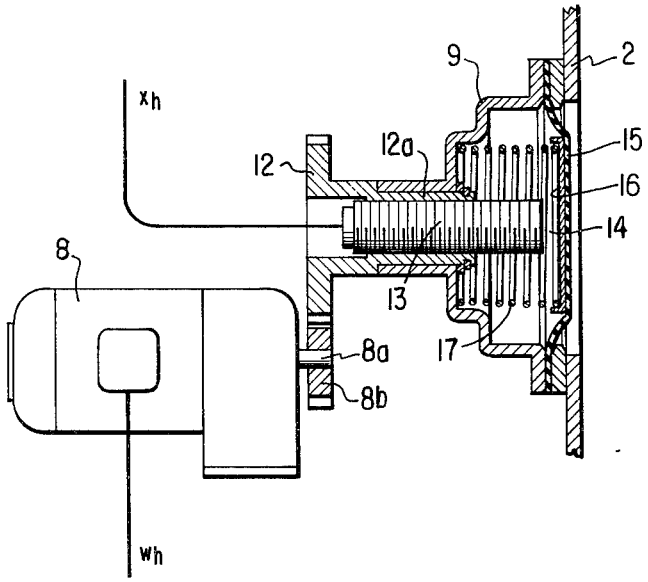
FIG. 2 is a sectional view of a component, on an enlarged scale, of a detail of FIG. 1.

Turning now to FIG. 2, the setting motor 8 has an output shaft 8*a* carrying a pinion 8*b* which, in turn, meshes with a spur gear 12 having an axial sleeve 12*a*. The latter has an inner thread which cooperates with a complemental outer thread provided on an inductive switch member 13 (electronic proximity switch) which is situated within the spur gear sleeve 12*a* and which forms part of the pressure-responsive precision switch 9. Thus, when the signal $w_h$ is applied to the motor 8, it rotates the spur gear 12*a* which causes the inductive switch 13 to shift, thus changing the distance 14 between the right-hand end (as viewed in FIG. 2) of the inductive switch 13 and a diaphragm 15 arranged in an opening of the wall of the lower tuft shaft 2 and displaceable in response to the tuft column pressure in the lower tuft shaft 2.

The diaphragm 15 which is arranged perpendicularly to the axis of and at a distance from the switch member 13, is made of an elastomer and is, on its side oriented away from the lower tuft shaft 2, provided with a metal plate 16 which serves as the seat for a compression spring 17 (arranged coaxially about the switch member 13) and as a control member for varying the flux density for the switch member 13. The reference output $w_h$ is applied to the pressure-responsive precision switch 9 for causing the latter to simultaneously function as the desired value setting means for the two-point regulator 10.In case of an increasing pressure exerted on the diaphragm 15, the latter, together with the metal plate 16, moves to the left (as viewed in FIG. 2) while deforming the compression spring 17. Thus, upon reaching a set setting pressure, the metal plate 16 enters into the switching zone of the inductive switch member 13. A conventional thyristor contained in the switch member 13 fires and generates a voltage across the output of the switch member 13. In case the pressure drops below the set switch-on pressure, the thyristor opens; as a result, the voltage across the output of the switch disappears again. This electronic pressure-responsive precision switch 9 constitutes a component of a regulator system; the diaphragm 15 is the measuring member of this regulator system. By means of the pressure-responsive precision switch 9 a two-point regulation can be effected in which thus, upon exceeding a predetermined pressure, a switch-on or switch-off operation is performed. In this manner a digital electric signal is obtained as the auxiliary regulating signal $x_h$ from the pressure in the tuft shaft 2.

In order to sense deviations from the desired value rapidly and in a simple manner, an optical indicator 18 and/or an acoustic indicator 19 is connected to the regulator 7. Advantageously, to the regulator 7 there is connected a recorder 20, such as a multi-color dot plotter to make possible the observation of the sliver control over long periods.

It will be understood that the above description of the present invention is susceptible to various modifications, changes and adaptations, and the same are intended to be comprehended within the meaning and range of equivalents of the appended claims.

What is claimed is:

1. An apparatus for regulating the sliver output of a carding machine supplied with a tuft column by a card feeder having a tuft shaft and feeding means for introducing tuft into the tuft shaft; comprising in combination:

(a) a sliver sensor for continuously sensing the throughput quantity of the sliver and generating a continuous main regulating signal as a function of the throughput quantity;

(b) a regulator connected to said sliver sensor for receiving said main regulating signal from said sliver sensor and generating a reference signal as a function of said main regulating signal;

(c) a tuft column sensor connected to said tuft shaft for sensing a variable of the tuft column advancing in said tuft shaft; said tuft column sensor having (1) signal generating means for emitting an auxiliary regulating signal as a function of the sensed variable of the tuft column;

(2) a desired value setting means being connected to said regulator for receiving said reference signal from said regulator and further being connected to said signal generating means of said tuft column sensor for varying said auxiliary regulating signal as a function of said reference signal; and (d) tuft column altering means being connected to said signal generating means of said tuft column sensor for receiving said auxiliary regulating signal and further being connected to said card feeder for altering the tuft column as a function of said auxiliary regulating signal.

2. An apparatus for regulating the sliver output of a carding machine supplied with a tuft column by a card feeder having a tuft shaft and feeding means for introducing tuft into the tuft shaft; comprising in combination:

(a) a sliver sensor for continuously sensing the throughput quantity of the sliver and generating a continuous main regulating signal as a function of the throughput quantity;

(b) a regulator connected to said sliver sensor for receiving said main regulating signal from said sliver sensor and generating a reference signal as a function of said main regulating signal;

(c) a tuft column sensor connected to said tuft shaft for sensing a variable of the tuft column advancing in said tuft shaft; said tuft column sensor having (1) signal generating means for emitting an auxiliary regulating signal as a function of the sensed variable of the tuft column;

(2) a desired value setting means being connected to said regulator for receiving said reference signal from said regulator and further being connected to said signal generating means of said tuft column sensor for varying said auxiliary regulating signal as a function of said reference signal; and (d) tuft column altering means being connected to said signal generating means of said tuft column sensor for receiving said auxiliary regulating signal and further being connected to said card feeder for altering the tuft column as a function of said auxiliary regulating signal; said tuft column altering means comprising an additional regulator having an input connected to said signal generating means of said tuft column sensor for receiving said auxiliary regulating signal and an output operatively connected to said card feeder for applying thereto a setting signal as a function of said auxiliary regulating signal to alter said tuft column as a function of said setting signal.

3. An apparatus as defined in claim 2, wherein said card feeder comprises an upper tuft shaft and a lower tuft shaft; said feeding means introducing tuft from said upper tuft shaft to said lower tuft shaft and wherein said tuft column sensor is a pressure-responsive precision sensor switch connected to said lower tuft shaft.

4. An apparatus as defined in claim 2 wherein said card feeder comprises an upper tuft shaft and a lower tuft shaft; said feeding means being constituted by a feeding roller introducing tuft from said upper tuft shaft to said lower tuft shaft; said feeding roller forming part of said tuft column altering means.

5. An apparatus as defined in claim 2, wherein said sliver sensor is constituted by a sliver funnel which is arranged downstream of said carding machine and through which the sliver passes.

6. An apparatus as defined in claim 2, wherein said regulator is a three-point regulator.

7. An apparatus as defined in claim 2, further comprising an optical indicator connected to said regulator.

8. An apparatus as defined in claim 2, further comprising an acoustic indicator connected to said regulator.

9. An apparatus as defined in claim 2, further comprising a recording device connected to said regulator.

10. An apparatus as defined in claim 2, wherein said desired value setting means comprises a setting motor driven as a function of said reference signal.

11. An apparatus for regulating the sliver output of a carding machine supplied with a tuft column by a card feeder having a tuft shaft and feeding means for introducing tuft into the tuft shaft; comprising in combination:

(a) a sliver sensor for continuously sensing the throughput quantity of the sliver and generating a continuous main regulating signal as a function of the throughput quantity;

(b) a regulator connected to said sliver sensor for receiving said main regulating signal from said sliver sensor and generating a reference signal as a function of said main regulating signal;

(c) a tuft column sensor connected to said tuft shaft for sensing a variable of the tuft column advancing in said tuft shaft; said tuft column sensor having (1) signal generating means for emitting an auxiliary regulating signal as a function of the sensed variable of the tuft column; said signal generating means including an inductive sensor switch, a diaphragm displaceable in response to the pressure in said tuft shaft for moving with respect to said inductive sensor switch for varying the flux density of said inductive sensor switch;

(2) a setting motor being connected to said regulator for receiving said reference signal and being further connected to said signal generating means for varying the distance between said diaphragm and said inductive sensor switch for varying the flux density of said inductive sensor switch to alter said auxiliary regulating signal as a function of said reference signal; and (d) tuft column altering means being connected to said inductive sensor switch for receiving said auxiliary regulating signal and further being connected to said card feeder for altering the tuft column as a function of said auxiliary regulating signal.

12. An apparatus as defined in claim 11, wherein said inductive sensor switch is displaceable with respect to said diaphragm and wherein said setting motor is connected to said inductive sensor switch for displacing said inductive sensor switch with respect to said diaphragm as a function of said reference signal.

13. An apparatus as defined in claim 11, wherein said tuft column altering means comprises an additional regulator having an input connected to said inductive sensor switch for receiving said auxiliary regulating signal and an output operatively connected to said card feeder for applying thereto a setting signal as a function of said auxiliary regulating signal to alter said tuft column as a function of said setting signal.

14. An apparatus as defined in claim 13, wherein said inductive sensor switch is displaceable with respect to said diaphragm and wherein said setting motor is connected to said inductive sensor switch for displacing said inductive sensor switch with respect to said diaphragm as a function of said reference signal.

* * * * *